US007103302B2

(12) United States Patent
Kameyama

(10) Patent No.: US 7,103,302 B2
(45) Date of Patent: Sep. 5, 2006

(54) IMAGE FORMING APPARATUS

(75) Inventor: Shigeru Kameyama, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/914,216

(22) Filed: Aug. 10, 2004

(65) Prior Publication Data

US 2005/0041994 A1 Feb. 24, 2005

(30) Foreign Application Priority Data

Aug. 20, 2003 (JP) ..... 2003-296302

(51) Int. Cl.
*G03G 15/00* (2006.01)

(52) U.S. Cl. ..... 399/167

(58) Field of Classification Search ..... 347/116; 399/46, 49, 299, 167, 301
See application file for complete search history.

(56) References Cited

U.S. PATENT DOCUMENTS 5,881,346 A 3/1999 Mori et al. ..... 399/301

FOREIGN PATENT DOCUMENTS

| | | |
|---|---|---|
| EP | 0 895 132 A2 | 2/1999 |
| EP | 1 429 201 A1 | 6/2004 |
| JP | 9-146329 | 6/1997 |
| JP | 2000-187428 | 7/2000 |
| JP | 2001-22147 | 1/2001 |

OTHER PUBLICATIONS

Patent Abstracts of Japan, Publication No. 2000-187428, Jul. 4, 2000.

*Primary Examiner*—Hoang Ngo
(74) *Attorney, Agent, or Firm*—Fitzpatrick, Cella, Harper & Scinto

(57) ABSTRACT

The image forming apparatus includes a plurality of rotation members for bearing respective images, a plurality of motors for driving and rotating the plurality of rotation members, respectively, a phase detector for detecting phases of the plurality of rotation members, and a phase adjusting device for carrying out adjustment so that phase differences among the plurality of rotation members have a predetermined relationship, in which the phase adjusting device carries out the adjustment before the motor in rotation is stopped, and stops the motor after completion of the adjustment. Accordingly, a first print time can be shortened without executing an unnecessary phase adjustment sequence after activating motors. Alternatively, after executing and completing the phase adjustment, the motors are stopped.

11 Claims, 12 Drawing Sheets

IMAGE FORMING APPARATUS

BACKGROUND OF THE INVENTION

1. Field of the Invention

The present invention relates in general to an apparatus and a method for forming an image, and more particularly to an image forming apparatus of an electrophotographic process and a controller therefor.

2. Related Background Art

FIG. 12 shows a color image forming apparatus 10 including image forming means for four colors, yellow Y, magenta M, cyan C and black K. Note that symbols a, b, c and d which are added to respective reference numerals in the figure correspond to yellow Y, magenta M, cyan C and black K, respectively. The color image forming apparatus 10 includes photosensitive drums 1*a*, 1*b*, 1*c* and 1*d* for forming respective electrostatic latent images, and motors 6*a*, 6*b*, 6*c* and 6*d* for driving the respective photosensitive drums 1*a*, 1*b*, 1*c* and 1*d*.

Laser scanners 2*a*, 2*b*, 2*c* and 2*d* for carrying out exposure in correspondence to an image signal to form electrostatic latent images on the photosensitive drums 1*a*, 1*b*, 1*c* and 1*d* are disposed above the photosensitive drums 1*a*, 1*b*, 1*c* and 1*d*, respectively. In addition, the image forming apparatus 10 includes a conveyance belt 3 for successively conveying a sheet to image forming parts for the respective colors, drive rollers 4 connected to drive means having a motor, a gear and the like in order to drive the conveyance belt 3, a motor 6*e* for driving the drive rollers 4, and a fixing device 5 for melting and fixing toner transferred onto a sheet.

Data of an image to be printed is transmitted from a personal computer (PC) to a printer. When the image formation corresponding to a system of a printer engine is completed, and then an operation state becomes a state where the printing can be carried out, a sheet is fed from a sheet cassette. When the sheet arrives at the conveyance belt 3, the sheet is successively conveyed to the image forming parts for the respective colors by the conveyance belt 3. Image signals of the respective colors are sent to the respective laser scanners 2*a*, 2*b*, 2*c* and 2*d* in correspondence to a timing at which the sheet is conveyed by the conveyance belt 3 to form electrostatic latent images onto the respective photosensitive drums 1*a*, 1*b*, 1*c* and 1*d*. The electrostatic latent images are then developed with toners by developing devices (not shown) to be transferred onto the sheet in transferring parts (not shown), respectively. In the figure, the images are formed on the sheet in order of yellow Y, magenta M, cyan C and black K. Thereafter, the sheet is separated from the conveyance belt 3, and the toner image is then fixed onto the sheet by the heat in a fixing device to be discharged to the outside.

Incidentally, in the multi-color image forming apparatus constructed as described above, differences in the image formation positions of the respective colors appears as misregistration in the image to cause degradation of the image quality. The misregistration can be roughly classified into a stationary misregistration generated due to the position shift when assembling the developing devices of the respective colors (hereinafter referred to as "D.C. misregistration"), and a periodic misregistration generated due to the deviation of shafts of rotation members (hereinafter referred to as "A.C. misregistration").

As for measures taken to cope with the A.C. color drift, there is known a method described in Japanese Patent Application Laid-Open No. 2001-022147. Thus, a technique for individually controlling rotation phases of the rotation members of the respective colors is known. However, the above-mentioned method has the following disadvantages. That is, a first print time becomes long all the more since a phase adjustment sequence is necessarily carried out whenever the motors are activated.

SUMMARY OF THE INVENTION

In the light of the foregoing, it is an object of the present invention to provide an image forming apparatus which is capable of shortening a first print time without executing an unnecessary phase adjustment sequence in activating the motors.

It is another object of the present invention to provide an image forming apparatus which is capable of omitting execution of an unnecessary phase adjustment sequence after activation of the motors to shorten a first print time.

It is further object of the present invention to provide an image forming apparatus which is capable of omitting an unnecessary phase adjustment operation after activation of the motors to shorten a first print time.

It is still further object of the present invention to provide an image forming apparatus including a plurality of rotation members that bear respective images, a plurality of motors that drive and rotate the plurality of rotation members, respectively, a phase detector that detects phases of the plurality of rotation members, and a motor controller that carries out an adjustment so that phase differences among the plurality of rotation members have a predetermined relationship, wherein the motor controller carries out the adjustment before each of the plurality of motors in rotation is stopped, and stops each of the plurality of motors after completion of the adjustment.

Other objects, constitutions and effects of the present invention will become clear from the following detailed description and the accompanying drawings.

DESCRIPTION OF THE PREFERRED EMBODIMENTS

The present invention will hereinafter be described in detail on the basis of preferred embodiments shown in the accompanying drawings.

First Embodiment

Figure 12:
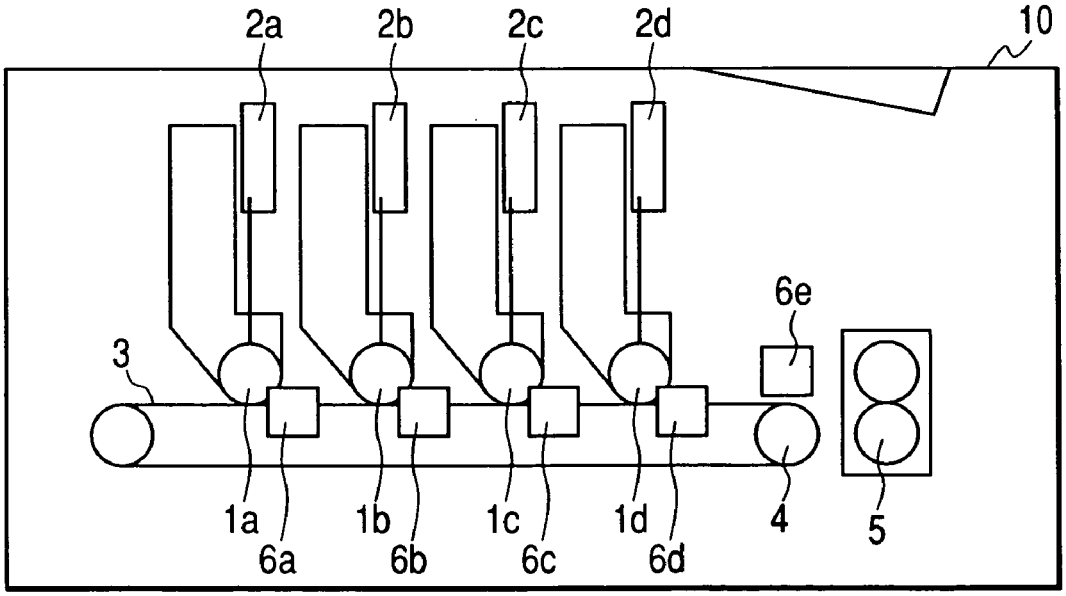
FIG. 12 is a schematic view explaining the whole construction of a conventional image forming apparatus.

An image forming apparatus according to a first embodiment of the present invention has the same construction as that shown in FIG. 12. In the figure, the phase control is carried out with respect to the photosensitive drums 1*a* to 1*d* in accordance with the present invention to suppress the misregistration.

Figure 2:
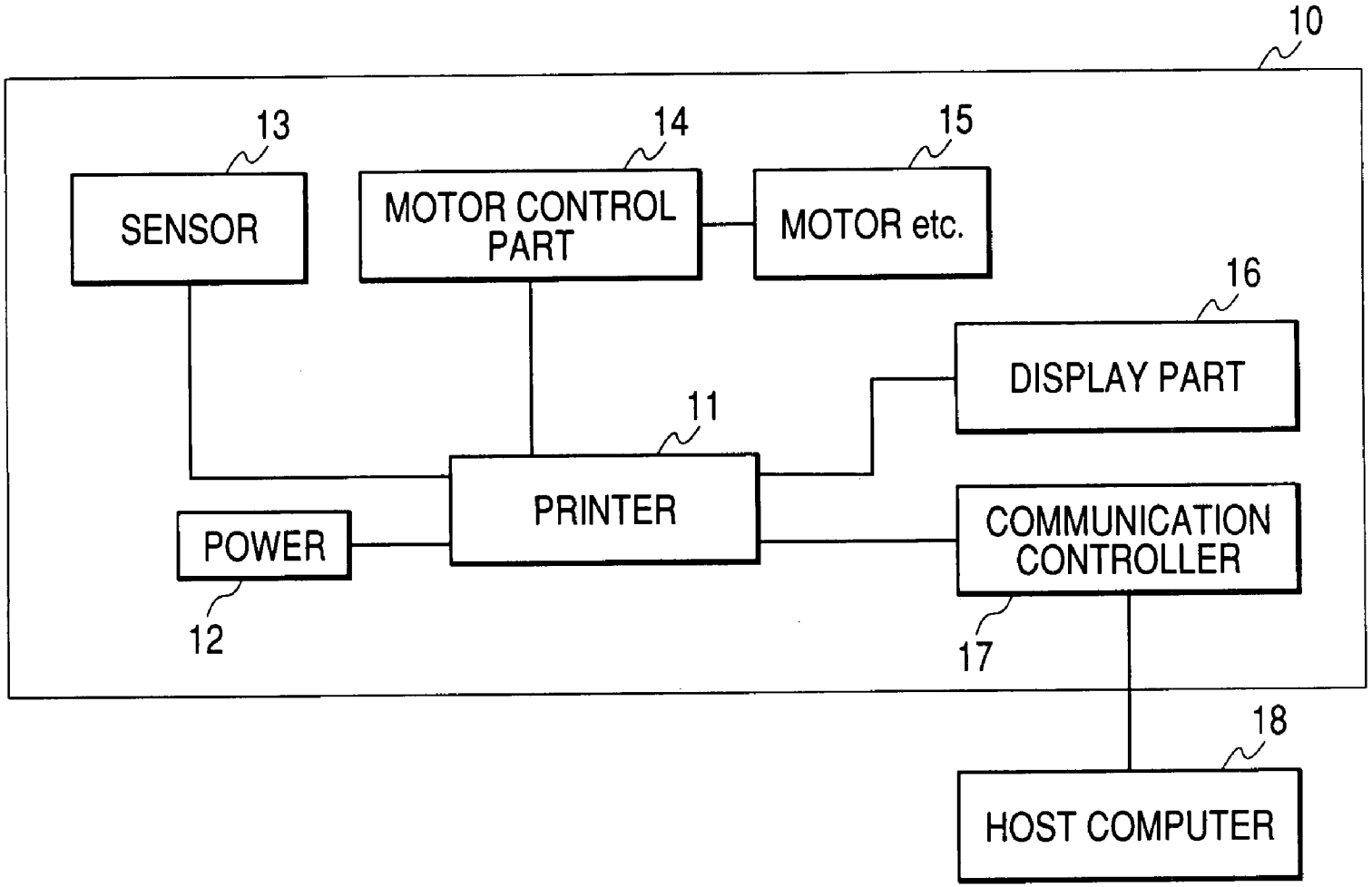
FIG. 2 is a block diagram explaining a schematic configuration of a control system of an image forming apparatus according to the first embodiment of the present invention.

Since other constituent elements and operation of the image forming apparatus according to this embodiment are the same as those of the related art example, their descriptions are omitted here for the sake of simplicity. FIG. 2 is a block diagram explaining a schematic configuration of a control system of the image forming apparatus according to the first embodiment of the present invention. A printer control part 11 for controlling printer parts is provided inside a printer 10 serving as the image forming apparatus. A power 12, sensors 13, a motor control part 14, a display part 16 and a communication controller 17 are connected to the printer control part 11. The power 12 supplies an electric power to each of the parts provided inside the printer 10. The sensors 13 detect situations of the respective parts provided inside the printer 10. The motor control part 14 is connected to motors 15 as well as to the printer control part 11. The motors 15 as power sources drive the parts in the printer 10. The motors 15 are controlled in accordance with instructions issued from the motor control part 14. The display part 16 informs a user of an operation situation of the printer 10. The communication controller 17 controls a communication between the printer 10 and a host computer 18. The printer 10 is connected to the host computer 18 through the communication controller 17. The host computer 18 transfers data of an image to be printed to the printer 10.

Figure 1:
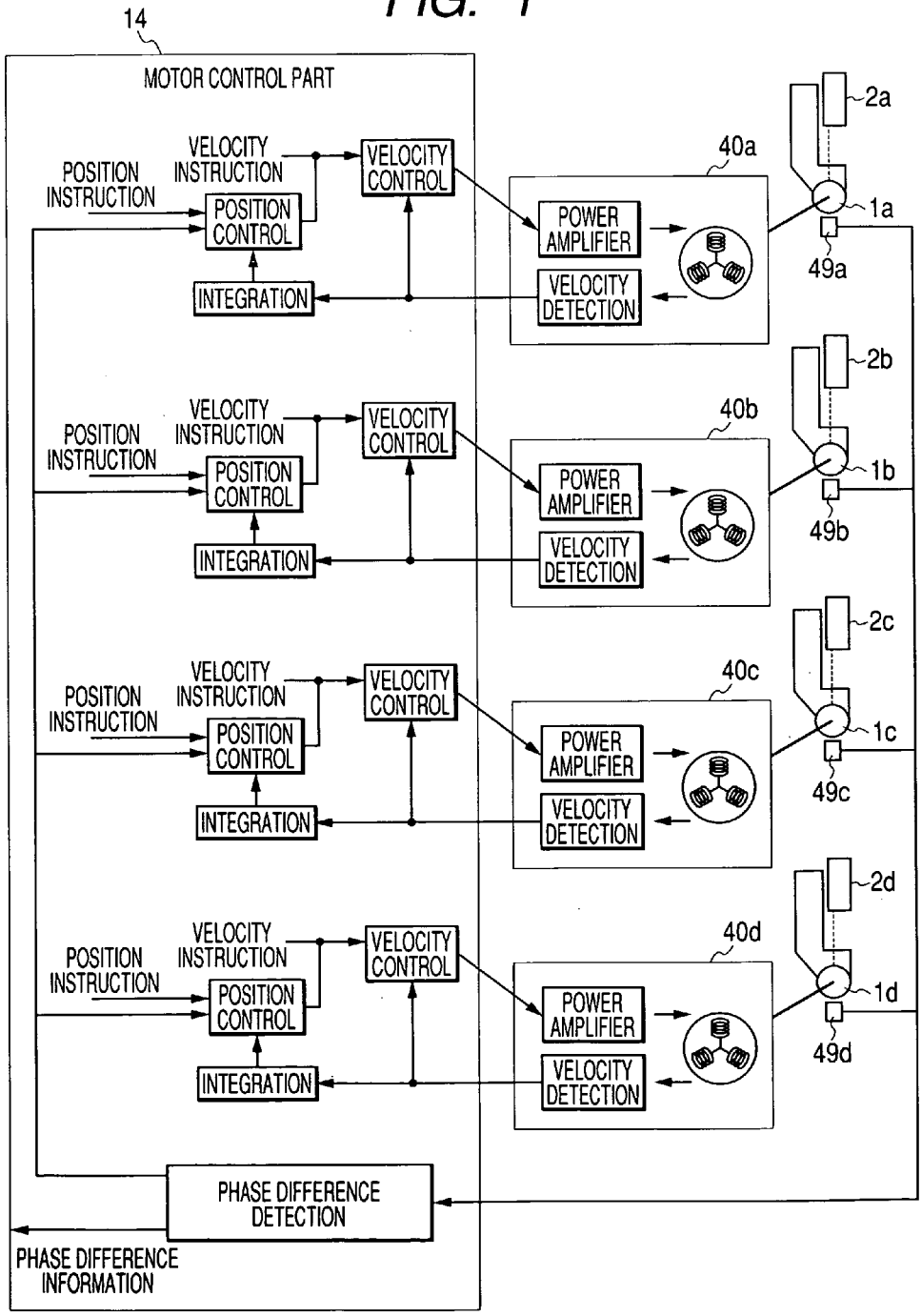
FIG. 1 is a block diagram, partly in schematic view, explaining a configuration of a main part of a first embodiment of the present invention.
Figure 3:
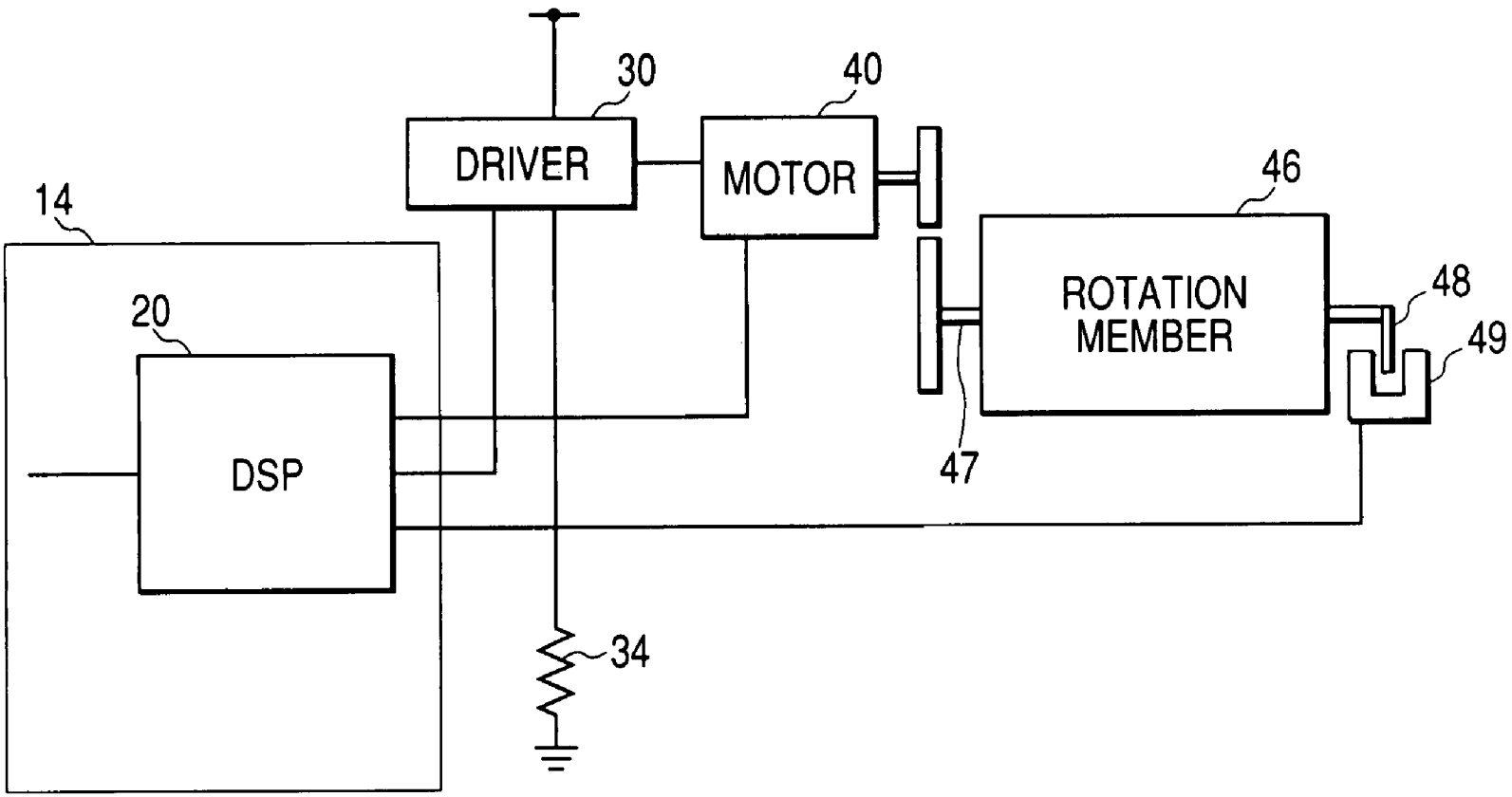
FIG. 3 is a schematic view explaining a construction of a main part of the first embodiment of the present invention.
Figure 4:
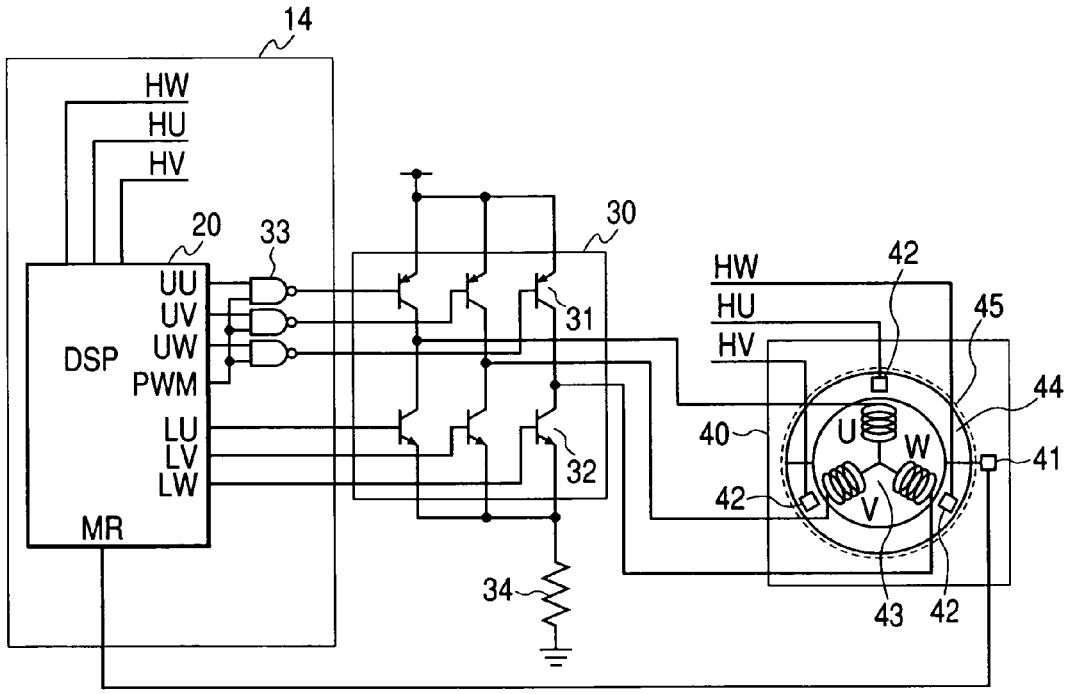
FIG. 4 is a circuit diagram explaining a configuration of the main part of the first embodiment of the present invention.

A configuration of a main part of the image forming apparatus according to the present invention will hereinafter be described with reference to FIGS. 1, 3 and 4. The image forming apparatus includes a plurality of rotation members 46, a plurality of D.C. brushless motors 40 for driving and rotating a plurality of rotation members 46, respectively, a driver 30 for controlling an electric power supplied to each of a plurality of D.C. brushless motors 40, a photosensor 49 for detecting phases of a plurality of rotation members 46, and the motor control part 14 for carrying out adjustment so that phase differences among a plurality of rotation members 46 two by two have a predetermined relationship. The motor control part 14 includes a digital signal processor (DSP) 20. A plurality of rotation members 46 correspond to the photosensitive drums 1*a*, 1*b*, 1*c* and 1*d* shown in FIG. 12, respectively.

The DSP 20 is connected to a plurality of D.C. brushless motors 40, the driver 30, and the photosensor 49. Flag members 48 are provided in shafts of the rotation members 46 and serve to block off an optical path of the photosensor 49 along with the rotation of the shafts. As a result, a signal is outputted once from the photosensor 49 whenever the shaft of the rotation member 46 is rotated once. Alternatively, there may also be adopted a construction in which flag members are provided in the rotation members 46 or the gears for driving the respective rotation members 46 and serve to block off an optical path of the photosensor 49.

Each of the D.C. brushless motors 40 has coils 43 which are connected in the form of three-phase star connection for phases U, V and W, and a rotor 44. In addition, each of the D.C. brushless motors 40 includes three Hall elements 42 for detecting magnetic poles of the rotor 44 as position detection means for the rotor 44. Output terminals of the three Hall elements 42 are connected to the DSP 20. Also, each of the D.C. brushless motors 40 has rotation speed detection means including a magnetic pattern 45 and a magnetic sensor 41 which are provided on an outer periphery of the rotor 44. Output terminals of the magnetic pattern 45 and the magnetic sensor 41 are connected to the DSP 20.

The driver 30 for driving the D.C. brushless motor 40 includes three high-side transistors 31 and three low-side transistors 32 which are connected to the coils 43 of the phases U, V and W, respectively. A current detection resistor 34 is connected to the driver 30 in order to convert a motor drive current into a voltage. The resultant voltage is taken in a D/A port of the DSP 20.

The DSP 20 carries out phase change-over control in accordance with a rotor position signal from the D.C. brushless motor 40, carries out control for start and stop of the motor in accordance with a control signal from the printer control part 11, and carries out speed control through the driver 30 on the basis of comparison of a speed signal from the printer control part 11 with an output signal from the speed detection means. When each of the D.C. brushless motor 40 in rotation is intended to be stopped, each of the D.C. brushless motor 40 in rotation is stopped after the phase adjustment is carried out to be completed.

Figure 5:
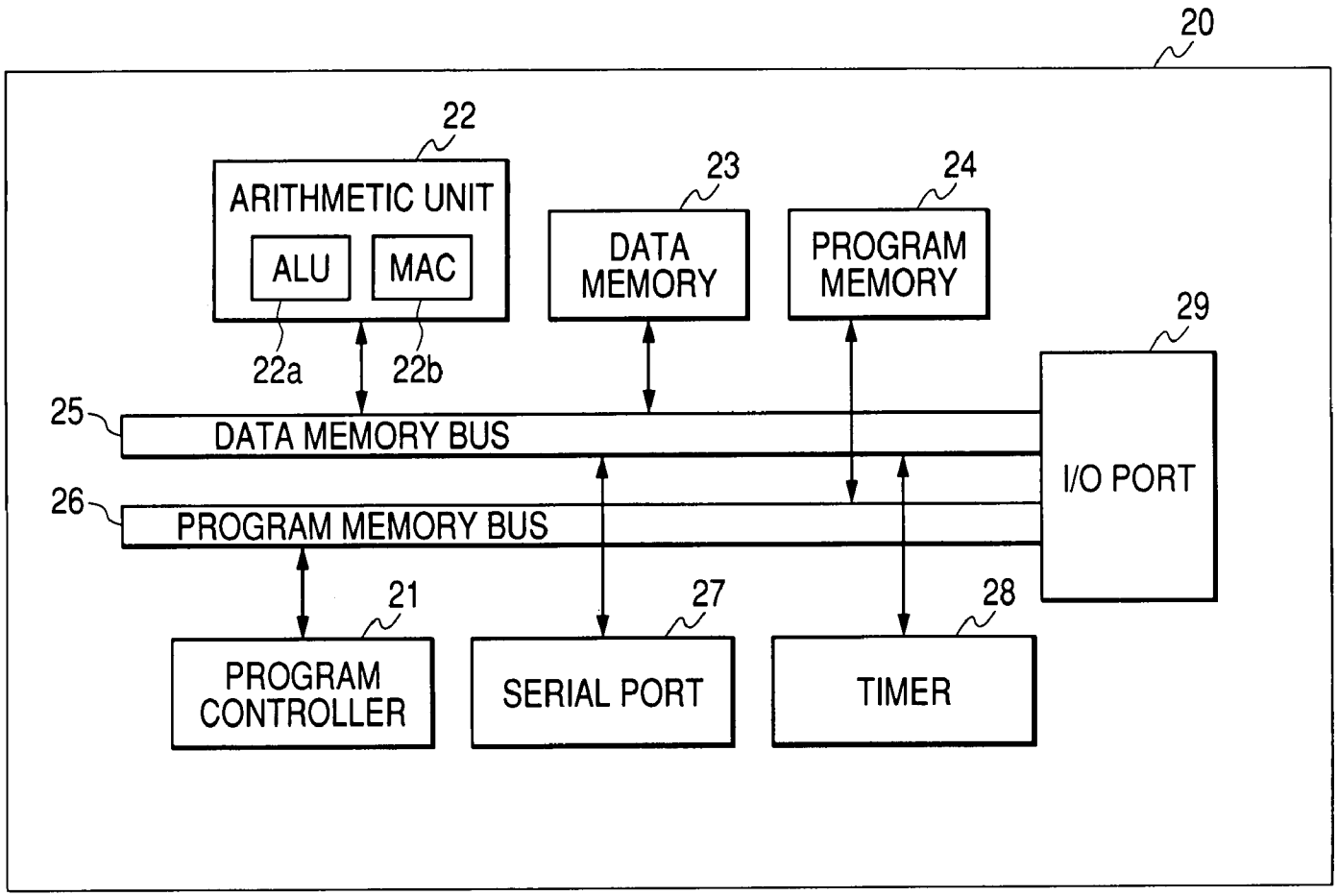
FIG. 5 is a block diagram explaining a configuration of the main part of the first embodiment of the present invention.

Next, FIG. 5 shows a block diagram of the DSP 20. The DSP 20 is provided with a program controller 21, an arithmetic unit 22 including an arithmetic and logic unit (ALU) 22*a* for carrying out an addition and subtraction operation, and a logical arithmetic operation, and a multiplication and addition operation circuit (MAC) 22*b* for carrying out an arithmetic operation for a sum of products, a data memory 23, a program memory 24, a data memory bus 25, a program memory bus 26, a serial port 27, a timer 28, and an I/O port 29. In such a manner, the memory is separated into the data memory 23 and the program memory 24, and the bus is also separated into the data memory bus 25 and the program memory bus 26. In addition, the DSP 20 has the MAC 22*b* for carrying out a multiplication operation and an addition operation with one machine cycle to thereby make the high speed arithmetic operation possible.

The DSP 20 specifies a position of the rotor 44 on the basis of rotor position signals HU, HV and HW generated from the three Hall elements 42, respectively, to generate phase change-over signals UU, UV and UW, and LU, LV and LW. The high-side transistors 31 and the low-side transistors 32 of the driver 30 are controlled so as to be turned ON/OFF in accordance with the phase change-over signals UU, UV and UW, and LU, LV and LW to change successively the phases the coils of which are to be excited over to one another to thereby rotate the rotor 44.

Moreover, in order to carry out the speed control, the DSP 20 compares rotation speed information with a rotation speed target value to obtain speed error information. In addition, in order to carry out the position control, the DSP 20 compares position information of the rotor 44 obtained by integrating the rotation speed information with a position target value to obtain position error information. Then, the DSP 20 arithmetically operates the quantity of operation of the motor on the basis of the above-mentioned speed error information and position error information to generate and output a PWM signal on the basis of the arithmetic operation results. When a value of the PWM signal is zero, duty is zero, and when a value of the PWM signal is 255, duty is 100. NANDs between the PWM signal and the phase change-over signals UU, UV and UW are obtained in respective NAND gates 33 to carry out chopping for a drive current to control the rotation speed of the motor. It should be noted that all the above-mentioned arithmetic operations may be carried out in the DSP 20 without using any of the NAND gates 33.

In addition, the three low-side transistors 31 are turned ON for all the phases U, V and W to allow the brake to be applied to the D.C. brushless motor 40. Since the drive roller 4 and the motor 6*e* have the same configurations as those of the foregoing, their descriptions are omitted here for the sake of simplicity.

Figure 6:
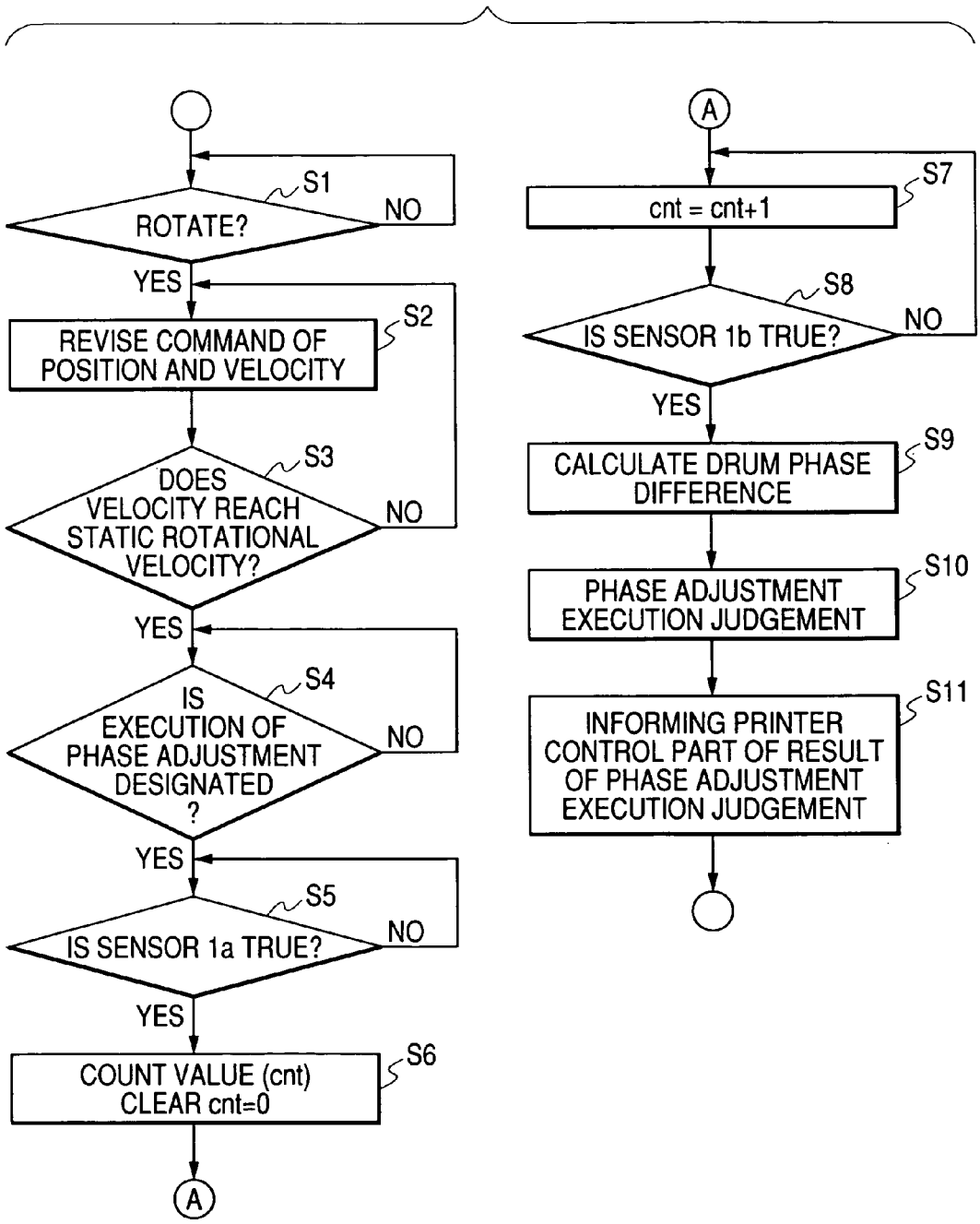
FIG. 6 is a flowchart explaining an operation of the image forming apparatus according to the first embodiment of the present invention.

Next, a description will hereinafter be given with respect to a case where the drive control is carried out for the photosensitive drum 1*b* with the rotation of the photosensitive drum 1*a* as a reference with reference to FIGS. 6 and 7.

When the motor control part 14 is instructed to activate the motors 15 from the printer control part 11 (Step S1 in FIG. 6), the motor control part 14 carries out the speed control and the position control for each of the motors 15. Then, the motor control part 14 revises a position command in accordance with a predetermined acceleration curve so as to minimize relative speed differences among the motors 15 to thereby accelerate the motors 15 (Step S2 in FIG. 6). When the rotation speeds of all the motors 15 reach respective static rotation speeds, the acceleration operation for each of the motors 15 is completed (Step S3 in FIG. 6). Next, when the execution of the phase adjustments for the photosensitive drums 1*a* to 1*d* is designated from the printer control part 11 (Step S4 in FIG. 6), a rotation phase difference between the photosensitive drum 1*a* having the rotation as the reference and the photosensitive drum 1*b* is started to be detected. That is, when an output signal is outputted from the photosensor 49 for the photosensitive drum 1*a* having the rotation as the reference, a count value cnt for time measurement is cleared (Steps S5 and S6 in FIG. 6). Thereafter, the count value cnt is incremented with a fixed cycle (Step S7 in FIG. 6). When an output signal of the photosensor 49 for the photosensitive drum 1*b* is outputted, the increment of the count value cnt is stopped (Step S8 in FIG. 6). The measured time periods are then converted into respective phase differences of the photosensitive drums 1*a* to 1*d*, and are also converted into a plurality of kinds of position error information of the motors 15 (Step S9 in FIG. 6). Then, each of the phase differences of the photosensitive drums 1*a* to 1*d* is compared with a predetermined value to judge whether or not it is necessary to execute the phase adjustments for the photosensitive drums 1*a* to 1*d* (Step S10 in FIG. 6). The printer control part 11 is informed of the results of the phase adjustment execution judgment (Step S11 in FIG. 6).

The printer control part 11, in response to the results of the phase adjustment execution judgment for the photosensitive drums 1*a* to 1*d*, executes a printing sequence when the phase adjustment execution is unnecessary, and instructs the motor control part 14 to execute the phase adjustment when the phase adjustment execution is necessary, and then executes a printing sequence after completion of the phase adjustment executions.

Figure 7:
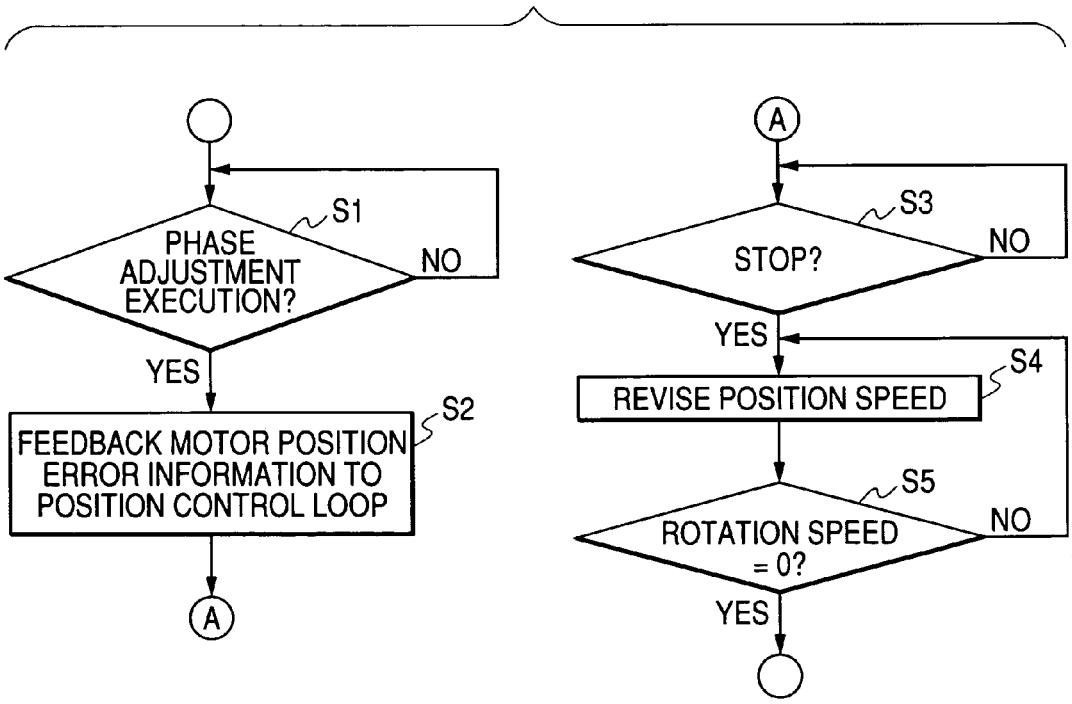
FIG. 7 is a flowchart explaining the operation of the image forming apparatus according to the first embodiment of the present invention.

When the motor control part 14 is instructed to execute the phase adjustments from the printer control part 11 (Step S1 in FIG. 7), the motor control part 14 feedbacks a plurality of kinds of motor position error information obtained from the judgment operation about the phase adjustment execution to respective position control loops of the motors 15 to carry out the control so as to cancel the position errors of the motors 15 (Step S2 in FIG. 7).

At this time, values of parameters used in the arithmetic operation for the quantity of operation of the position control loop may be changed on the basis of an absolute value of the position error information. For example, when the absolute value of the position error information is large, a gain of the position control loop is reduced to ensure the stability of the control.

Moreover, when the motor control part 14 is instructed to stop the motors 15 from the printer control part 11 (Step S3 in FIG. 7), the motor control part 14 revises the position command in accordance with a fixed deceleration curve so as to minimize the relative speed differences among the motors 15 to thereby decelerate the motors 15. When the motors 15 are stopped, a deceleration sequence is completed (Step S5 in FIG. 7). The deceleration curve is made gentler than that in a case where when the load torque is the smallest, the motors 15 are naturally decelerated due to the friction losses.

After a series of printing operations are completed, the printer control part 11 instructs the motor control part 14 to judge whether or not it is necessary to execute the phase adjustments for the photosensitive drums 1*a* to 1*d*, and to execute the phase adjustment. Then, the motor control part 14 stops the motors 15 after completion of execution of the phase adjustments.

Alternatively, the printer control part 11 may instruct the motor control part 14 to make a judgement about execution of the phase adjustment and to execute the phase adjustment during the operation for clearing the rotation members 46, the conveyance belt or the transfer belt. The cleaning operation is carried out whenever images are printed on a predetermined number of sheets.

The control operation as described above is performed for minimizing the relative speed differences between the motors in activation and the motors in stop. The motors are operated so as not to cause phase shifts between desired phases of the rotation members and the actual phases of the rotation members. Moreover the phase adjustment is carried out at least one or more times during the rotation of the motors to thereby suppress the misregistration. The phase shifts are thus held to a degree in which it is practically unnecessary to carry out the phase adjustment before execution of the printing.

In addition, the printer control part 11 activates an initial sequence in order to carry out the cleaning operation for the rotation members such as the photosensitive drums 1*a* to 1*d* in turning ON the power for a printer engine or in closing an access door to the inside of the printer engine. When the printer control part 11 activates the initial sequence, the printer control part 11 instructs the motor control part 14 to activate the motors 15 and to adjust the phases of the rotation members. Though in turning ON the power or in closing the access door, there is a possibility that the rotation phases of the rotation members may be largely shifted from respective desired rotation phases of the rotation members, this initial sequence operation allows the rotation phases of the rotation members to be adjusted to desired values of the rotation members. In this case, since no printing operation is carried out, there is no problem even if the rotation speeds of the motors are changed due to the phase adjustments. Then, during the actual printing operation, the rotation phases of the rotation members are held in a state where the rotation phases of the rotation members are nearly adjusted to the desired phases of the rotation members on the basis of the initial sequence. Hence, it is unnecessary to execute the phase adjustments whenever the motors are activated, and thus the first print time is prevented from being lengthened.

Moreover, before the calibrations such as the correction of misregistration and the correction of concentration are carried out, the printer control part 11 can instruct the motor control part 14 to perform the phase adjustment judgment and to execute the phase adjustments. As a result, the calibrations can be carried out in a state where the photosensitive drums 1*a* to 1*d* are free from the phase difference shifts, and hence the accuracy of the calibrations is prevented from becoming worse.

It should be noted that the desired rotation phases, i.e., such rotation phases of the rotation members as to suppress the A.C. misregistrations are obtained in advance by executing a rotation phase detection sequence and data of the rotation phases is transmitted from the printer control part 11 to the motor control part 14.

Second Embodiment

An image forming apparatus according to a second embodiment of the present invention will hereinafter be described. Since a configuration of the image forming apparatus according to this embodiment, and a schematic configuration of a control system are the same as those of the first embodiment, their descriptions are omitted here for the sake of simplicity.

A point of difference from the first embodiment is that when the motor in driving is stopped as well as when the motor is activated, the control is carried out on the basis of only the speed control without carrying out the position control.

Figure 8:
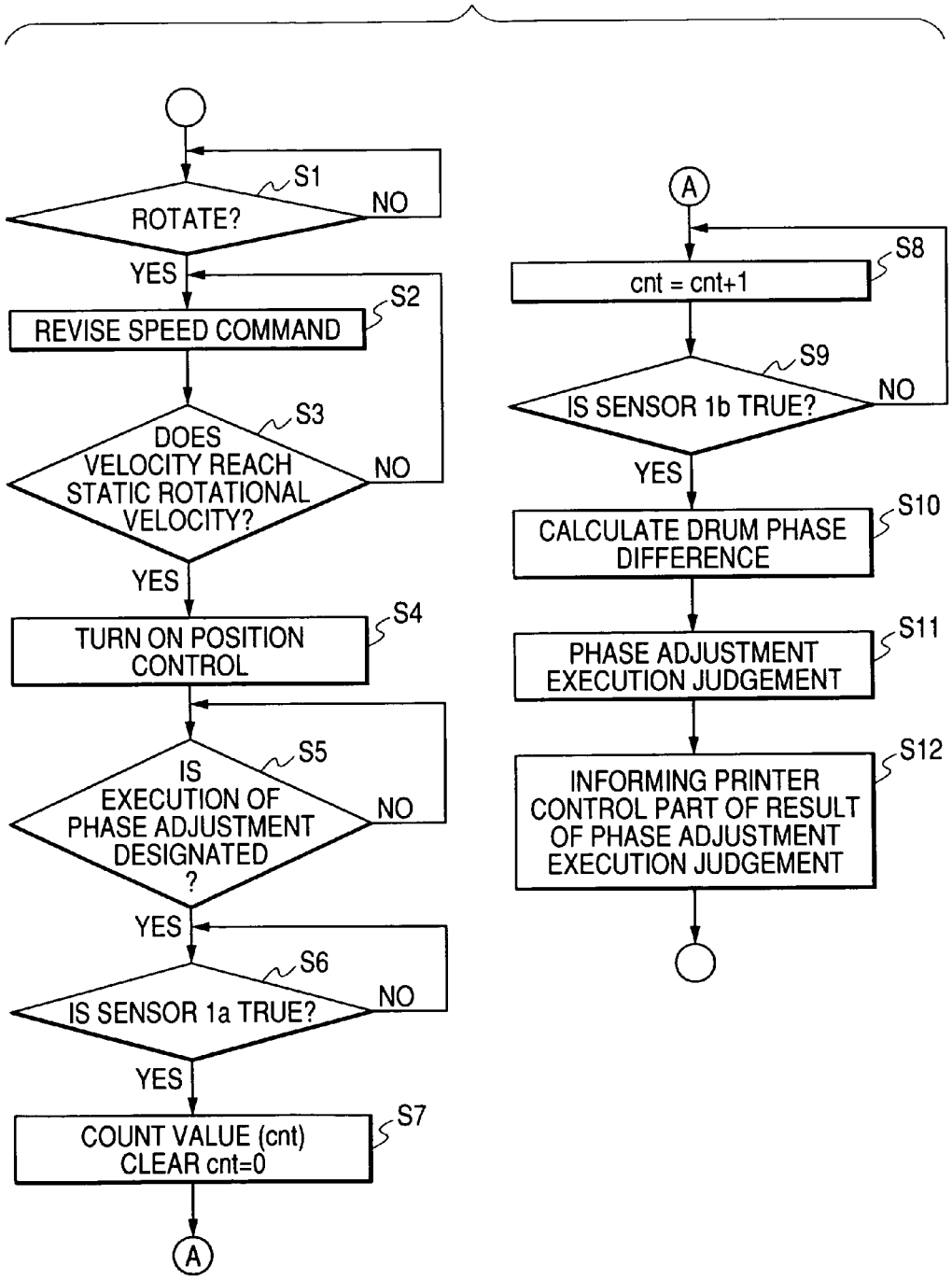
FIG. 8 is a flowchart explaining an operation of an image forming apparatus according to a second embodiment of the present invention.
Figure 9:
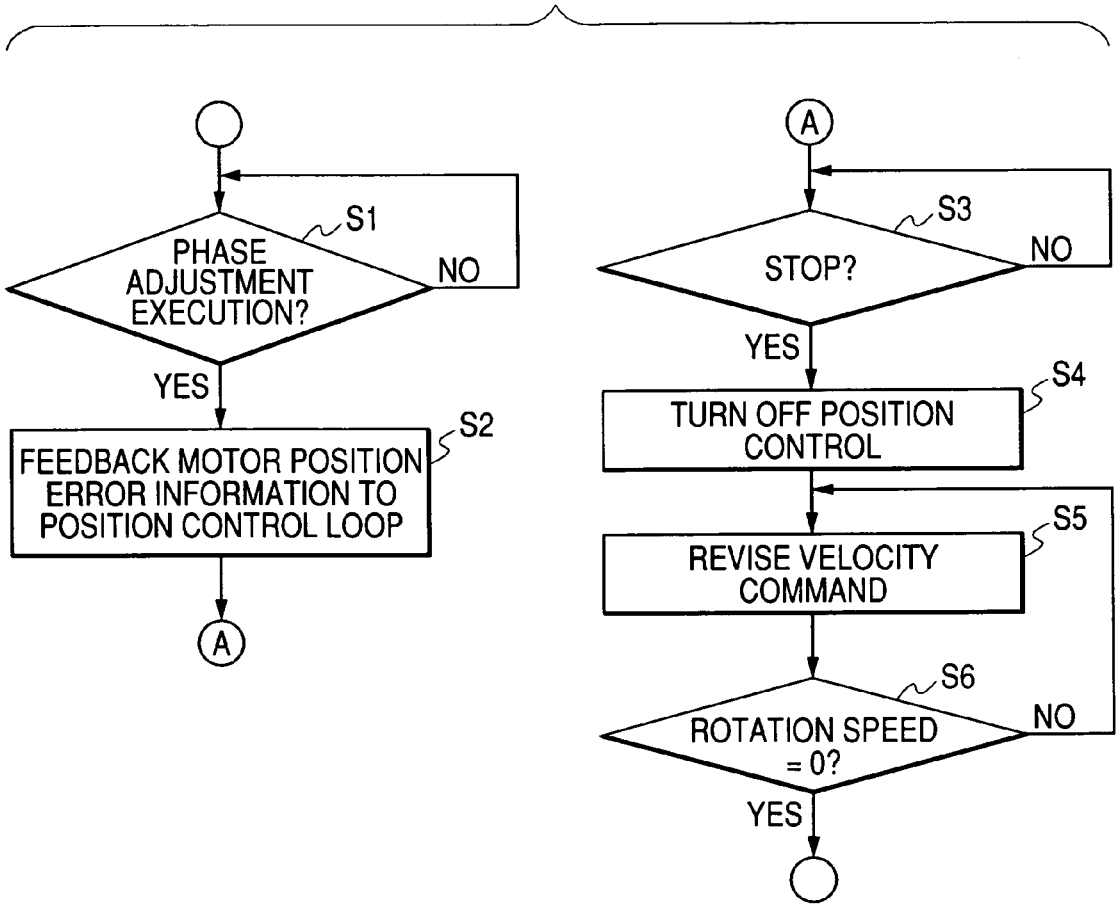
FIG. 9 is a flowchart explaining the operation of the image forming apparatus according to the second embodiment of the present invention.

An operation of the image forming apparatus according to this embodiment will hereinafter be described with reference to FIGS. 8 and 9. When the motor control part 14 is instructed to activate the motors 15 from the printer control part 11 (Step S1 in FIG. 8), the motor control part 14 carries out the speed control for each of the motors 15 to revise a speed command in accordance with a fixed acceleration curve so as to minimize relative speed differences among the motors 15 to thereby accelerate the motors 15 (Step S2 in FIG. 8). When the rotation speeds of all the motors reach respective final rotation speeds, the position control is started (Step S3 in FIG. 8).

Since the operation for making a judgment about execution of the phase adjustments, and the operation for the phase adjustments are the same as those of the first embodiment, their descriptions are omitted here for the sake of simplicity.

When the motor control part 14 is instructed to stop the motors 15 from the printer control part 11 (Step S3 in FIG. 9), the motor control part 14 discontinues the position control (Step S4 in FIG. 9), and then revises a speed command in accordance with a fixed deceleration curve so as to minimize relative speed differences among the motors 15 on the basis of only the speed control (Step S5 in FIG. 9) to thereby decelerate the motors 15. When the rotation speeds of the motors 15 become zero, the deceleration sequence is completed (Step S6 in FIG. 3). Alternatively, When the rotation speeds of the motors 15 become equal to or slower than a predetermined speed, the brake may be applied to the motors 15. This deceleration curve is made gentler than that in a case where when the load torque is smallest, the motors 15 are naturally decelerated due to the friction losses.

Instead, the motors 15 may be decelerated in accordance with the fixed deceleration curve by carrying out the braking operation for the motors 15. The deceleration curve in this case is made steeper than that in a case where when the load torque is largest, the motors 15 are naturally decelerated due to the friction losses.

Alternatively, there may also be adopted an operation in which the rotation states of the motors 15 are changed over to low speed rotations once while carrying out the position control, and thereafter the motors 15 are stopped.

Since the operation of the printer control part 11 is the same as that in the first embodiment, its description is omitted here for the sake of simplicity.

The control operation as described above is performed for minimizing the relative speed differences between the motors in activation and the motors in stop. The motors are operated so as not to cause phase shifts between desired phases of the rotation members and the actual phases of the rotation members. Moreover the phase adjustment is carried out at least one or more times during the rotation of the motors to thereby suppress the misregistration. The phase shifts are thus held to a degree in which it is practically unnecessary to carry out the phase adjustment before execution of the printing while activating the motors.

In addition, the printer control part 11 activates an initial sequence in order to carry out the cleaning operation for the rotation members such as the photosensitive drums 1*a* to 1*d* in turning ON the power for a printer engine or in closing an access door to the inside of the printer engine. When the printer control part 11 activates the initial sequence, the printer control part 11 instructs the motor control part 14 to activate the motors 15 and to adjust the phases of the rotation members. Though in turning ON the power or in closing the access door, there is a possibility that the rotation phases of the rotation members may be largely shifted from respective desired rotation phases of the rotation members, this initial sequence operation allows the rotation phases of the rotation members to be adjusted to desired values of the rotation members. In this case, since no printing operation is carried out, there is no problem even if the rotation speeds of the motors are changed due to the phase adjustments. Then, during the actual printing operation, the rotation phases of the rotation members are held in a state where the rotation phases of the rotation members are nearly adjusted to the desired phases of the rotation members on the basis of the initial sequence. Hence, it is unnecessary to execute the phase adjustments whenever the motors are activated, and thus the first print time is prevented from being lengthened.

Moreover, before the calibrations such as the correction of misregistration and the correction of concentration are carried out, the printer control part 11 can instruct the motor control part 14 to perform the phase adjustment judgment and to execute the phase adjustments. As a result, the calibrations can be carried out in a state where the photosensitive drums 1*a* to 1*d* are free from the phase difference shifts, and hence the accuracy of the calibrations is prevented from becoming worse.

It should be noted that the desired rotation phases, i.e., such rotation phases of the rotation members as to suppress the A.C. misregistration are obtained in advance by executing a rotation phase detection sequence and data of the rotation phases is transmitted from the printer control part 11 to the motor control part 14.

Third Embodiment

An image forming apparatus according to a third embodiment of the present invention will hereinafter be described. Since a configuration of the image forming apparatus according to this embodiment, and a schematic configuration of a control system are the same as those of the first embodiment, their descriptions are omitted here for the sake of simplicity.

A point of difference from the first embodiment is that each of a plurality of kinds of home position information of the rotation members is compared with information of a signal which is independent of a plurality of kinds of home position information of the rotation members to arithmetically operate a plurality of kinds of position error information of the motors.

Figure 10:
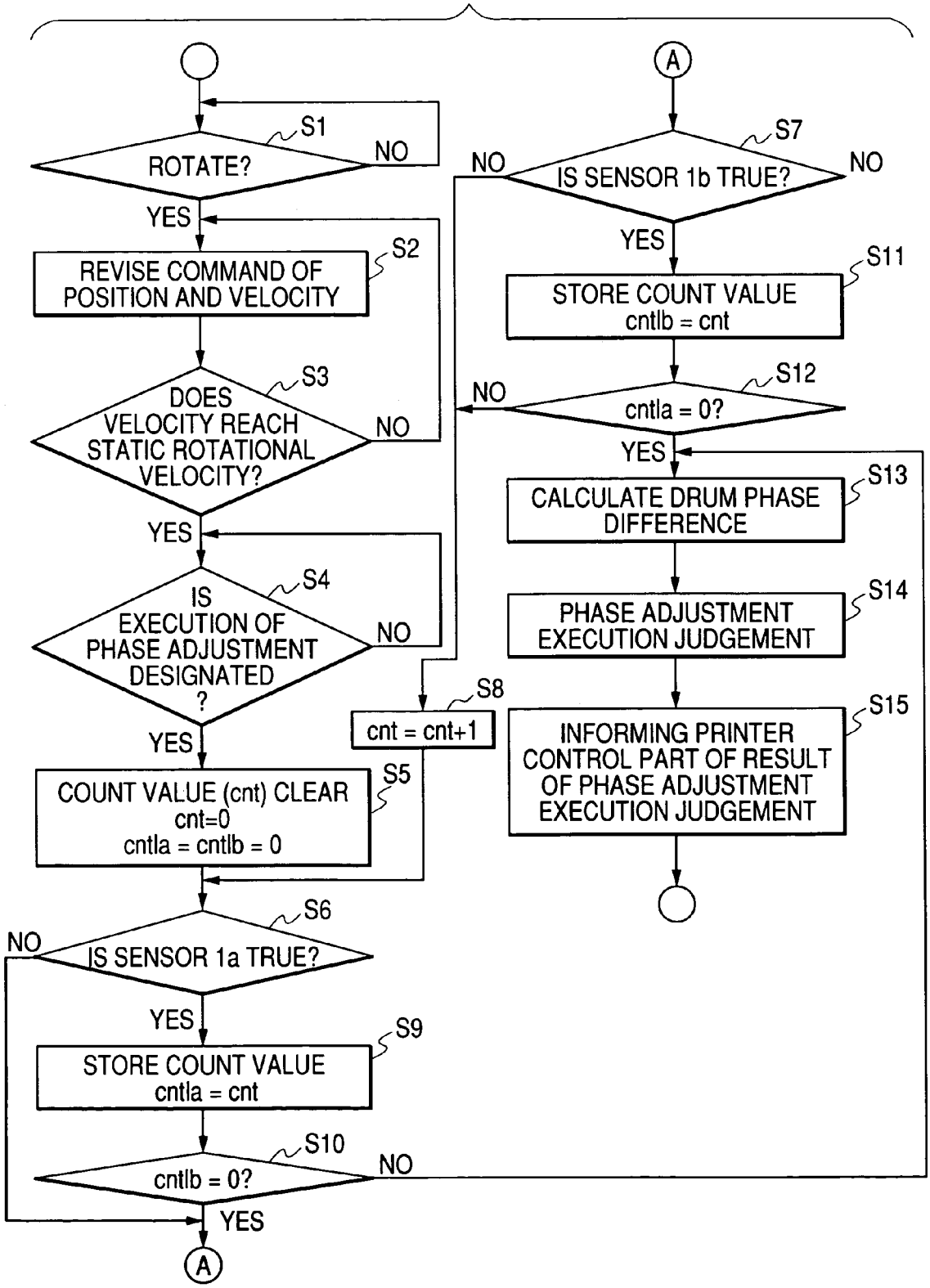
FIG. 10 is a flowchart explaining an operation of an image forming apparatus according to a third embodiment of the present invention.
Figure 11:
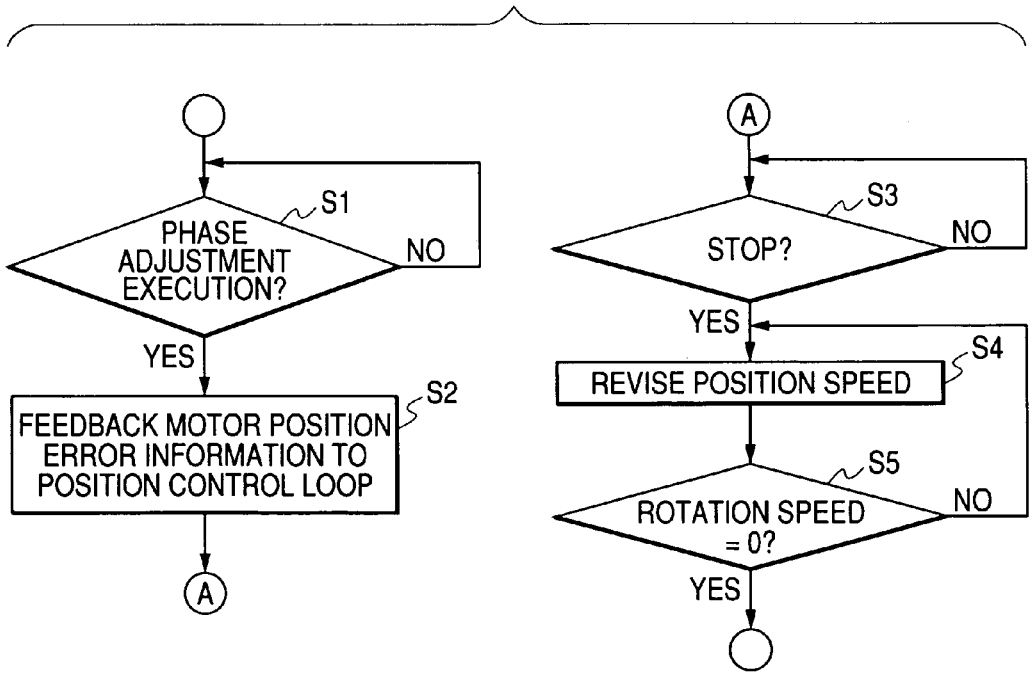
FIG. 11 is a flowchart explaining the operation of the image forming apparatus according to the third embodiment of the present invention.

An operation of the image forming apparatus according to this embodiment will hereinafter be described with reference to FIGS. 10 and 11. When the motor control part 14 is instructed to activate the motors 15 from the printer control part 11 (step S1 in FIG. 10), the motor control part 14 carries out the speed control and the position control for each of the motors 15 to revise a position command in accordance with a predetermined acceleration curve so as to minimize relative speed differences among the motors 15 to thereby accelerate the motors 15 (Step S2 in FIG. 10). When the rotation speeds of all the motors reaches the respective static rotation speeds, the acceleration operation is completed (Step S3 in FIG. 10).

Next, when making a judgment about execution of the phase adjustments for the photosensitive drums 1*a* to 1*d* is designated by the printer control part 11 (Step S4 in FIG. 10), a rotation phase difference between the photosensitive drum 1*a* having the rotation as the reference and the photosensitive drum 1*b* is started to be detected. That is, the count value cnt for time measurement until an output signal is outputted from the photosensor for the photosensitive drum is cleared at a certain timing (Step S5 in FIG. 10). Thereafter, the output signal of the photosensor for the photosensitive drums 1*a* to 1*d* is monitored (Steps S6 and S7 in FIG. 10), and also the count value cnt is incremented at fixed intervals (Step S8 in FIG. 10). When the output signal is outputted from the photosensor for the photosensitive drum 1*a*, the count value is stored as cnt1*a* (Step S9 in FIG. 10) and When the output signal is outputted from the photosensor for the photosensitive drum 1*b*, the count value is stored as cnt1*b* (Step S11 in FIG. 10). When the measurement for both the home position photosensitive drums 1*a* and 1*b* is completed, a plurality of kinds of phase difference information of the photosensitive drums and a plurality of kinds of position error information of the motors are arithmetically operated on the basis of a difference between the count values cnt1*a* and cnt1*b* thus measured (Step S13 in FIG. 10). Thereafter, each of the phase differences of the respective photosensitive drums is compared with a predetermined value to judge whether or not it is necessary to execute the phase adjustments for the photosensitive drums (Step S14 in FIG. 10). The printer control part 11 is informed of the judgment results (Step S15 in FIG. 10).

Since the operation for adjusting the phases of the motors, the motor stopping operation and the operation of the printer control part 11 are the same as those in the first embodiment, their descriptions are omitted here for the sake of simplicity.

The control operation as described above is performed for minimizing the relative speed differences between the motors in activation and the motors in stop. The motors are operated so as not to cause phase shifts between desired phases of the rotation members and the actual phases of the rotation members. Moreover the phase adjustment is carried out at least one or more times during the rotation of the motors to thereby suppress the color drifts. The phase shifts are thus held to a degree in which it is practically unnecessary to carry out the phase adjustment before execution of the printing while activating the motors.

In addition, the printer control part 11 activates an initial sequence in order to carry out the cleaning operation for the rotation members such as the photosensitive drums 1*a* to 1*d* in turning ON the power for a printer engine or in closing an access door to the inside of the printer engine. When the printer control part 11 activates the initial sequence, the printer control part 11 instructs the motor control part 14 to activate the motors 15 and to adjust the phases of the rotation members. Though in turning ON the power or in closing the access door, there is a possibility that the rotation phases of the rotation members may be largely shifted from respective desired rotation phases of the rotation members, this initial sequence operation allows the rotation phases of the rotation members to be adjusted to desired values of the rotation members. In this case, since no printing operation is carried out, there is no problem even if the rotation speeds of the motors are changed due to the phase adjustments. Then, during the actual printing operation, the rotation phases of the rotation members are held in a state where the rotation phases of the rotation members are nearly adjusted to the desired phases of the rotation members on the basis of the initial sequence. Hence, it is unnecessary to execute the phase adjustments whenever the motors are activated, and thus the first print time is prevented from being lengthened.

Moreover, before the calibrations such as the correction of misregistration and the correction of concentration are carried out, the printer control part 11 can instruct the motor control part 14 to perform the phase adjustment judgment and to execute the phase adjustments. As a result, the calibrations can be carried out in a state where the photosensitive drums 1*a* to 1*d* are free from the phase difference shifts, and hence the accuracy of the calibrations is prevented from becoming worse.

It should be noted that the desired rotation phases, i.e., such rotation phases of the rotation members as to suppress the A.C. color drifts are obtained in advance by executing a rotation phase detection sequence and data of the rotation phases is transmitted from the printer control part 11 to the motor control part 14.

While the present invention has been described above by giving the several preferred embodiments, it is to be understood that the present invention is not intended to be limited to these preferred embodiments, and hence the various changes and applications may be made without departing from the scope of the appended claims.

This application claims priority from Japanese Patent Application No. 2003-296302 filed on Aug. 20, 2003, which is hereby incorporated by reference herein.

What is claimed is:

1. An image forming apparatus, comprising:

a plurality of rotation members that bear respective images;

a plurality of motors that drive and rotate said plurality of rotation members, respectively;

a phase detector that detects phases of said plurality of rotation members; and a motor controller that carries out an adjustment so that phase differences among said plurality of rotation members have a predetermined relationship, wherein said motor controller carries out the adjustment before each of said plurality of motors in rotation is stopped, and stops said each of said plurality of motors after completion of the adjustment.

2. An image forming apparatus according to claim 1, wherein an initial sequence including a cleaning operation is carried out when a power supply is turned ON and when an access door is closed.

3. An image forming apparatus according to claim 1, wherein said motor controller carries out the adjustment before carrying out one of position shift correction and concentration correction.

4. An image forming apparatus according to claim 1, wherein said motor controller carries out the adjustment while carrying out the cleaning operation for said plurality of rotation members.

5. An image forming apparatus according to claim 1, wherein while said plurality of motors are being activated, rotation speeds of said plurality of motors are controlled to obtain a minimum difference between the rotation speeds.

6. An image forming apparatus according to claim 1, wherein while said plurality of motors are being stopped, rotation speeds of said plurality of motors are controlled to obtain a minimum difference between the rotation speeds.

7. An image forming apparatus according to claim 1, wherein said plurality of motors are stopped after rotation speeds of said plurality of motors are changed to be low temporarily.

8. An image forming apparatus according to claim 1, further comprising judgment means for judging whether or not it is necessary to adjust the phases of the plurality of rotation members based on detection results obtained from said phase detector, wherein when the image forming apparatus carries out a printing operation, said judgment means judges whether or not it is necessary to adjust the phases of said plurality of rotation members after said plurality of motors are activated, and when said judgment means judges that it is necessary to adjust the phases of said plurality of rotation members, the phases of said plurality of rotation members are adjusted by said motor controller, and when said judgment means judges that it is unnecessary to adjust the phases of said plurality of rotation members, a printing sequence is carried out.

9. An image forming apparatus according to claim 1, wherein said plurality of motors are D.C. motors.

10. An image forming apparatus according to claim 9, wherein driving control for said D.C. motors is carried out based on a digital signal processing.

11. An image forming apparatus according to claim 10, wherein one of a DSP and a microcomputer is used in the digital signal processing.

* * * * *